US012678013B2

(12) United States Patent
Boyer et al.

(10) Patent No.: US 12,678,013 B2
(45) Date of Patent: Jul. 14, 2026

(54) DISHWASHER SECURING SYSTEMS

(71) Applicant: GD Midea Air Conditioning Equipment Co., Ltd., Foshan (CN)

(72) Inventors: Joel Boyer, Louisville, KY (US); Brian Riddle, Taylorsville, KY (US); Russell D. Dietrich, Mount Washington, KY (US)

(73) Assignee: Midea Group Co., Ltd., Foshan (CN)

( * ) Notice: Subject to any disclaimer, the term of this patent is extended or adjusted under 35 U.S.C. 154(b) by 74 days.

(21) Appl. No.: 18/594,737

(22) Filed: Mar. 4, 2024

(65) Prior Publication Data

US 2025/0275664 A1 Sep. 4, 2025

(51) Int. Cl.
*A47L 15/42* (2006.01)

(52) U.S. Cl.
CPC ..... *A47L 15/427* (2013.01)

(58) Field of Classification Search
CPC ..... A47L 15/427; A47L 15/4272; B60P 7/14; B60P 7/15; H02G 3/125
See application file for complete search history.

(56) References Cited

U.S. PATENT DOCUMENTS 4,737,056 A * 4/1988 Hunt ..... B60P 7/15 410/151
2008/0272267 A1* 11/2008 Kristensson ..... A47L 15/427 248/675

FOREIGN PATENT DOCUMENTS

| | | | | |
|---|---|---|---|---|
| CN | 209003184 U | 6/2017 | | |
| CN | 209573868 U | 11/2019 | | |
| CN | 209884065 U | 1/2020 | | |
| CN | 217525027 U | 10/2022 | | |
| CN | 116321828 A | 6/2023 | | |
| CN | 219720619 U | 9/2023 | | |
| EP | 2979604 A1 * | 2/2016 | ..... | F16B 21/02 |
| WO | WO-8910857 A2 * | 11/1989 | ..... | B60P 7/14 |

* cited by examiner

*Primary Examiner* — Matthew W Ing
(74) *Attorney, Agent, or Firm* — Dinsmore & Shohl LLP

(57) ABSTRACT

Embodiments of a dishwasher securing system are described herein. The dishwasher securing system may include a dishwasher, the dishwasher having a housing comprising a top face, a bottom face, and one or more side faces. The system may further include a threaded housing, the threaded housing coupled to the top face of the dishwasher, the threaded housing having a plurality of threaded holes. A first threaded leg may extend from the threaded housing, the first threaded leg having one or more threads configured to engage at least one of the plurality of threaded holes of the threaded housing. A second threaded leg may extend from the threaded housing, the second threaded leg having one or more threads configured to engage at least one of the plurality of threaded holes of the threaded housing.

20 Claims, 4 Drawing Sheets

DISHWASHER SECURING SYSTEMS

BACKGROUND

The present embodiments relate to systems for securing dishwashers, with particular embodiments shown for size adjustable systems for securing dishwashers within a cabinet opening or other similar opening.

Typical dishwasher securing systems may be configured to use brackets and mechanical fasteners to secure the dishwasher within a cabinet opening. This may create holes in the cabinets when fasteners are driven therethrough. If multiple dishwashers are installed in the same cabinet opening over time, the cabinets may be weakened by multiple holes being formed therein. Further, the brackets may not be size adjustable, which may require different length brackets to be used to accommodate different sized cabinet openings. Thus, there is a need for a dishwasher securing system that is size adjustable and that may secure the dishwasher without requiring holes to be formed in the cabinet opening.

SUMMARY

The herein-described embodiments address these and other problems associated with the art by providing systems for securing dishwashers within a cabinet opening or other openings. In various embodiments, a dishwasher securing system may include a dishwasher, the dishwasher having a housing comprising a top face, a bottom face, and one or more side faces. The system may further include a threaded housing, the threaded housing coupled to the top face of the dishwasher, and the threaded housing having a plurality of threaded holes. A first threaded leg may extend from the threaded housing, the first threaded leg having one or more threads configured to engage at least one of the plurality of threaded holes of the threaded housing. A second threaded leg may extend from the threaded housing, the second threaded leg having one or more threads configured to engage at least one of the plurality of threaded holes of the threaded housing.

In addition, in some embodiments a dishwasher securing system may include a dishwasher, the dishwasher having a housing having a top face, a bottom face, and a plurality of side faces. The system may further include one or more threaded extensions coupled to one of the plurality of side faces. Each of the one or more threaded extensions may be configured to be threaded outward relative to one of the plurality of side faces of the dishwasher.

In addition, in some embodiments a dishwasher securing system may include a dishwasher, the dishwasher having a housing having a top face, a bottom face, and a plurality of side faces. The system may include a plurality of racks, each of the plurality of racks coupled to the top face of the dishwasher having a plurality of grooved teeth. One or more arms may be coupled to each of the plurality of racks. The system may include a pinion. The pinion may include a plurality of gear teeth. The pinion may be configured to engage the plurality of grooved teeth of the plurality of racks. Each of the plurality of racks may be configured to extend outwardly when engaged by the pinion.

In addition, in some embodiments a dishwasher securing system may include a dishwasher the dishwasher having a housing comprising a top face, a bottom face, and one or more side faces. The system may further include a center pulley, the center pulley rotatably coupled to the top face of the dishwasher, wherein the center pulley comprises a lower groove and an upper groove. The system may further include a first extending arm comprising a first outer pulley, the first extending arm rotatably coupled to the top face of the dishwasher about the first outer pulley, wherein the first outer pulley comprises a first groove. The system may further include a second extending arm comprising a second outer pulley, the second extending arm rotatably coupled to the top face of the dishwasher about the second outer pulley, wherein the second outer pulley comprises a second groove. The system may further include a first cable, the first cable forming a continuous loop and coupled to the first groove of the first outer pulley and one of the upper groove or the lower groove of the center pulley. The system may further include a second cable, the second cable forming a continuous loop and coupled to the second groove of the second outer pulley and one of the upper groove or the lower groove of the center pulley, wherein the first cable and second cable are each coupled to a different groove of the center pulley.

In addition, in some embodiments a dishwasher securing system may include a dishwasher the dishwasher having a housing comprising a top face, a bottom face, and one or more side faces. The system may further include a first pin disposed through a first pin hole formed in one of the one or more side faces of the dishwasher. The system may further include a second pin disposed through a second pin hole formed in one of the one or more side faces of the dishwasher. The system may further include a first spring configured to bias the first pin outwardly from one of the one or more side faces of the dishwasher. The system may further include a second spring configured to bias the second pin outwardly from one of the one or more side faces of the dishwasher.

These and other advantages and features are set forth in the claims annexed hereto and forming a further part hereof. However, for a better understanding of the invention, and of the advantages and objectives attained through its use, reference should be made to the figures, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used in any way to the scope of the claimed subject matter.

DETAILED DESCRIPTION

Figure 1:
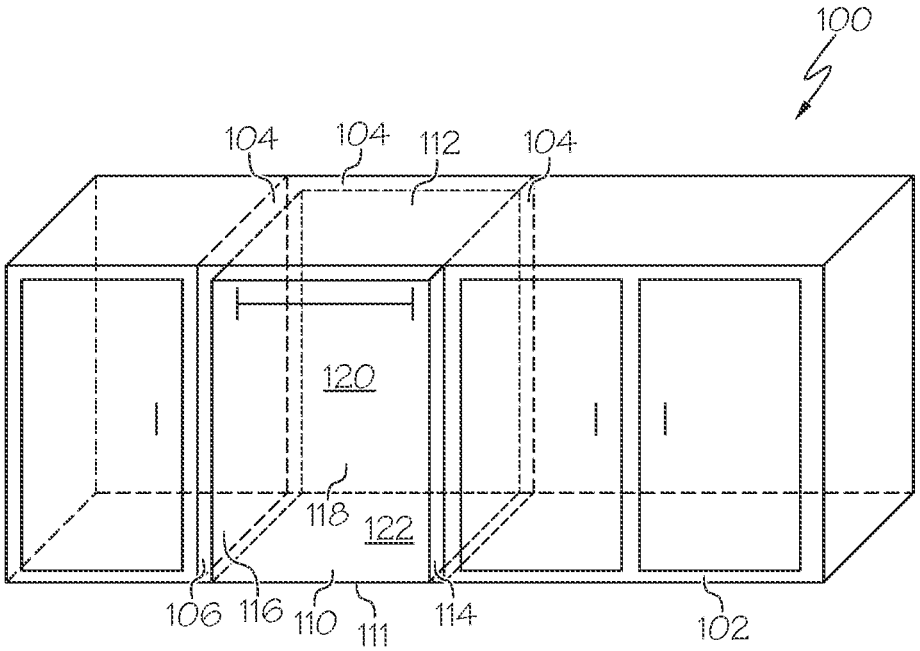
FIG. 1 is an isometric view of a dishwasher disposed within a cabinet opening, consistent with some embodiments of the dishwasher securing systems.

Turning now to the drawings, wherein like numbers denote like parts throughout the several views, FIG. 1 illustrates an example dishwasher and cabinet assembly 100. The dishwasher and cabinet assembly 100 may include a cabinet set 102. The cabinet set 102 may include a plurality of cabinet opening walls 104. The plurality of cabinet opening walls 104 may define a cabinet opening 106.

The dishwasher and cabinet assembly 100 includes a dishwasher 110. The dishwasher 110 may include a housing 111 having a top face 112, a first side face 114, a second side face 116, a rear face 118, a front door 120, and a bottom face 122. The dishwasher 110 may be shaped and sized so as to fit within the cabinet opening 106. A gap may exist between the dishwasher 110 and each of the cabinet opening walls 104. In some embodiments, a fascia or trim piece may be used to cover the gap.

The housing 111 may be constructed of any suitable material, including but not limited to plastic, metals such as stainless steel or aluminum, or any other suitable material. In some embodiments, different faces of the housing 111 may be constructed of different materials, such as the top face 112 being constructed of metal and each of the side faces being constructed of plastic.

Figure 2:
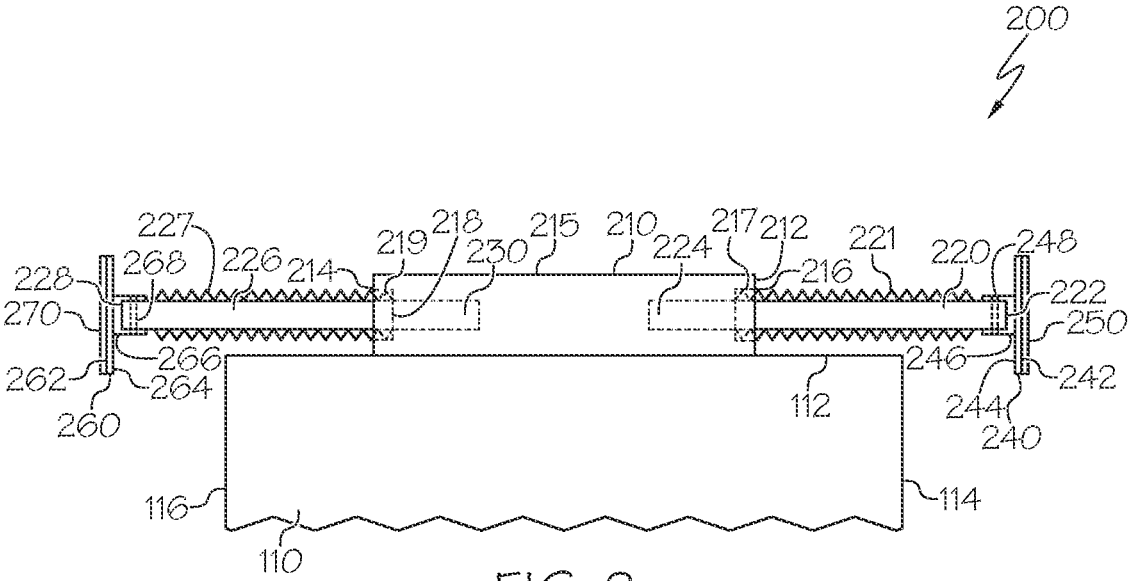
FIG. 2 is a front view of a dishwasher securing system, consistent with some embodiments of the dishwasher securing system.

FIG. 2 illustrates a front view of a dishwasher securing system 200 configured for use on the dishwasher 110. The dishwasher securing system 200 includes a threaded housing 210. The threaded housing 210 includes a first sidewall 212, a second sidewall 214, and a top wall 215. Each of the first sidewall 212 and second sidewall 214 are coupled to the top face 112 of the dishwasher 110. The first sidewall 212 and second sidewall 214 may be coupled to the top face 112 of the dishwasher 110 with any suitable coupling mechanism, including but not limited to adhesives, welding, mechanical fasteners, or any other suitable coupling mechanism. In some embodiments, the threaded housing 210 may be removably coupled to the top face 112 of the dishwasher 110.

The first sidewall 212 includes a first threaded hole 216, and the second sidewall 214 includes a second threaded hole 218. The first threaded hole 216 may include first internal threads 217, and the second threaded hole 218 may include second internal threads 219.

A first threaded leg 220 extends from the first threaded hole 216. The first threaded leg 220 may include first external threads 221. The first external threads 221 may be configured to threadably engage with the first threaded hole 216.

The first threaded leg 220 may include a first end 222 and a second end 224. The first threaded leg 220 may be configured such that when the first threaded leg 220 is threaded within the first threaded hole 216 in a first direction, the first threaded leg 220 is advanced relative to the first side face 114 of the dishwasher 110, such that the first end 222 is an increased distance away from the first side face 114 after the first threaded leg 220 is threaded within the first threaded hole 216 in the first direction. The first threaded leg 220 may be further configured such that when the first threaded leg 220 is threaded within the first threaded hole 216 in a second direction, where the second direction is opposite the first direction, the first threaded leg 220 is retracted relative to the first side face 114 of the dishwasher 110.

A second threaded leg 226 extends from the second threaded hole 218. The second threaded leg 226 may include second external threads 227. The second external threads 227 may be configured to threadably engage with the second threaded hole 218.

The second threaded leg 226 may include a first end 228 and a second end 230. The second threaded leg 226 may be configured such that when the second threaded leg 226 is threaded within the second threaded hole 218 in a first direction, the second threaded leg 226 is advanced relative to the second side face 116 of the dishwasher 110, such that the first end 228 is an increased distance away from the second side face 116 after the second threaded leg 226 is threaded within the second threaded hole 218 in the first direction. The second threaded leg 226 may be further configured such that when the second threaded leg 226 is threaded within the second threaded hole 218 in a second direction, where the second direction is opposite the first direction, the second threaded leg 226 is retracted relative to the second side face 116 of the dishwasher 110.

A first plate 240 may be coupled to the first end 222 of the first threaded leg 220. The first plate 240 may be a plate or similar flat structure. The first plate 240 may be configured to tension against the cabinet opening walls 104 (not shown).

The first plate 240 may include an outer face 242 and an inner face 244. A mounting bracket 246 may be coupled to the inner face 244. The mounting bracket 246 may be flexibly coupled to the first threaded leg via a mounting pin 248. The mounting pin 248 may allow the first plate 240 to flex relative to the first threaded leg 220 and/or the cabinet opening walls 104.

In further embodiments, it is contemplated that the first plate 240 may be coupled to the first threaded leg 220 by any other suitable coupling mechanism, including but not limited to welding or mechanical fasteners.

A first rubber insert 250 may be coupled to the outer face 242 of the first plate 240. The first rubber insert 250 may increase the coefficient of friction between the dishwasher securing system 200 and the cabinet set 102. This may aid in retaining the dishwasher 110 relative to the cabinet set 102 such as when the dishwasher 110 is bumped or otherwise receives a force load.

A second plate 260 may be coupled to the first end 228 of the second threaded leg 226. The second plate 260 may be a plate or similar flat structure. The second plate 260 may be configured to tension against the cabinet opening walls 104 (not shown).

The second plate 260 may include an outer face 262 and an inner face 264. A mounting bracket 266 may be coupled to the inner face 264. The mounting bracket 266 may be flexibly coupled to the second threaded leg 226 via a mounting pin 268. The mounting pin 268 may allow the second plate 260 to flex relative to the second threaded leg 226 and/or the cabinet opening walls 104.

In further embodiments, it is contemplated that the second plate 260 may be coupled to the second threaded leg 226 by any other suitable coupling mechanism, including but not limited to welding or mechanical fasteners.

A second rubber insert 270 may be coupled to the outer face 262 of the second plate 260. The second rubber insert 270 may increase the coefficient of friction between the dishwasher securing system 200 and the cabinet set 102. This may aid in retaining the dishwasher 110 relative to the cabinet set 102 such as when the dishwasher 110 is bumped or otherwise receives a force load.

Figure 3:
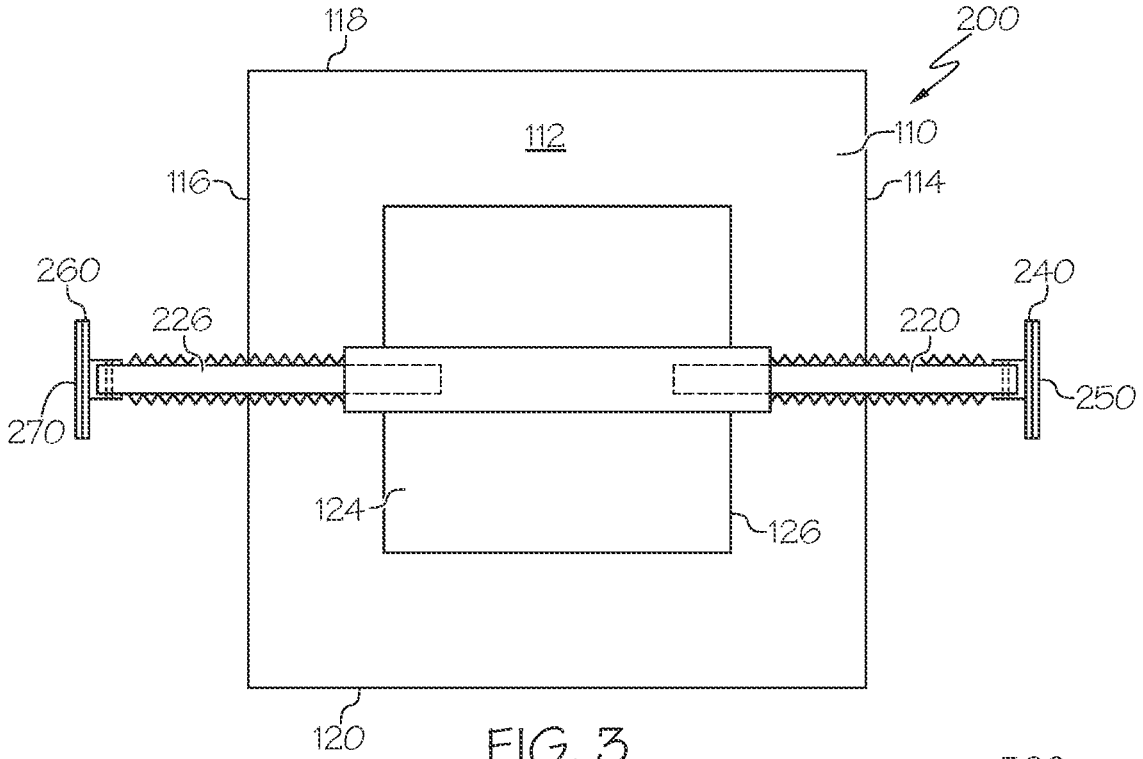
FIG. 3 is a top view of a dishwasher securing system and an access panel, consistent with some embodiments of the dishwasher securing system.

FIG. 3 illustrates a top view of the dishwasher securing system 200 configured for use on the dishwasher 110. An access panel 124 may be formed in the top face 112 of the dishwasher 110. The access panel 124 may be a removable panel that reveals an access opening 126 in the top face 112 of the dishwasher 110. The access opening 126 may allow an operator to access the first threaded leg 220 and the second threaded leg 226 by opening the front door 120. This may be used such as when there is insufficient clearance between the top face 112 and the cabinet opening wall 104 for an operator to grasp the first threaded leg 220 and/or the second threaded leg 226.

The access panel 124 may be removably coupled to the top face 112 through any suitable coupling mechanism, including but not limited to geometric fit, magnets, pins and holes, or any other suitable coupling mechanism.

Figure 4:
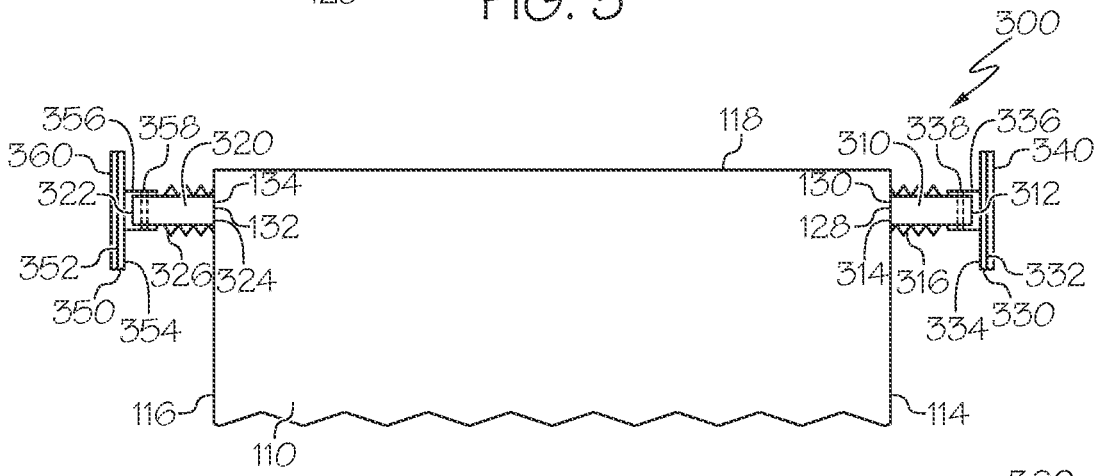
FIG. 4 is a front view of a dishwasher securing system, consistent with some embodiments of the dishwasher securing system.

FIG. 4 illustrates a front view of a dishwasher securing system 300. The dishwasher securing system 300 includes a first threaded extension 310. The first threaded extension 310 may include an outer end 312, an inner end 314, and one or more threads 316. The one or more threads 316 may be external threads. The dishwasher securing system 300 includes a second threaded extension 320. The second threaded extension 320 may include an outer end 322, and inner end 324, and one or more threads 326.

The dishwasher 110 may include a first threaded opening 128 and a second threaded opening 132. The first threaded opening 128 may include one or more threads 130. The one or more threads 130 may be internal threads. The one or more threads 130 may be configured to threadably engage with the one or more threads 316 of the first threaded extension 310. In embodiments, the first threaded extension 310 may be advanceable outwardly from the first side face 114 of the dishwasher 110 by threading the first threaded extension 310 relative to the first threaded opening 128.

The second threaded opening 132 may include one or more threads 134. The one or more threads 134 may be internal threads. The one or more threads 134 may be configured to threadably engage with the one or more threads 326 of the second threaded extension 320. In embodiments, the second threaded extension 320 may be advanceable outwardly from the second side face 116 of the dishwasher 110 by threaded the second threaded extension 320 relative to the second threaded opening 132.

A first plate 330 may be coupled to the outer end 312 of the first threaded extension 310. The first plate 330 may be a plate or similar flat structure. The first plate 330 may be configured to tension against the cabinet opening walls 104 (not shown).

The first plate 330 may include an outer face 332 and an inner face 334. A mounting bracket 336 may be coupled to the inner face 334. The mounting bracket 336 may be flexibly coupled to the first threaded leg via a mounting pin 338. The mounting pin 338 may allow the first plate 330 to flex relative to the first threaded extension 310 and/or the cabinet opening walls 104.

In further embodiments, it is contemplated that the first plate 330 may be coupled to the first threaded extension 310 by any other suitable coupling mechanism, including but not limited to welding or mechanical fasteners.

A first rubber insert 340 may be coupled to the outer face 332 of the first plate 330. The first rubber insert 340 may increase the coefficient of friction between the dishwasher securing system 300 and the cabinet set 102. This may aid in retaining the dishwasher 110 relative to the cabinet set 102 such as when the dishwasher 110 is bumped or otherwise receives a force load.

A second plate 350 may be coupled to the outer end 322 of the second threaded extension 320. The second plate 350 may be a plate or similar flat structure. The second plate 350 may be configured to tension against the cabinet opening walls 104 (not shown).

The second plate 350 may include an outer face 352 and an inner face 354. A mounting bracket 356 may be coupled to the inner face 354. The mounting bracket 356 may be flexibly coupled to the second threaded extension 320 via a mounting pin 358. The mounting pin 358 may allow the second plate 350 to flex relative to the second threaded extension 320 and/or the cabinet opening walls 104.

In further embodiments, it is contemplated that the second plate 350 may be coupled to the second threaded extension 320 by any other suitable coupling mechanism, including but not limited to welding or mechanical fasteners.

A second rubber insert 360 may be coupled to the outer face 352 of the second plate 350. The second rubber insert 360 may increase the coefficient of friction between the dishwasher securing system 300 and the cabinet set 102. This may aid in retaining the dishwasher 110 relative to the cabinet set 102 such as when the dishwasher 110 is bumped or otherwise receives a force load.

Figure 5:
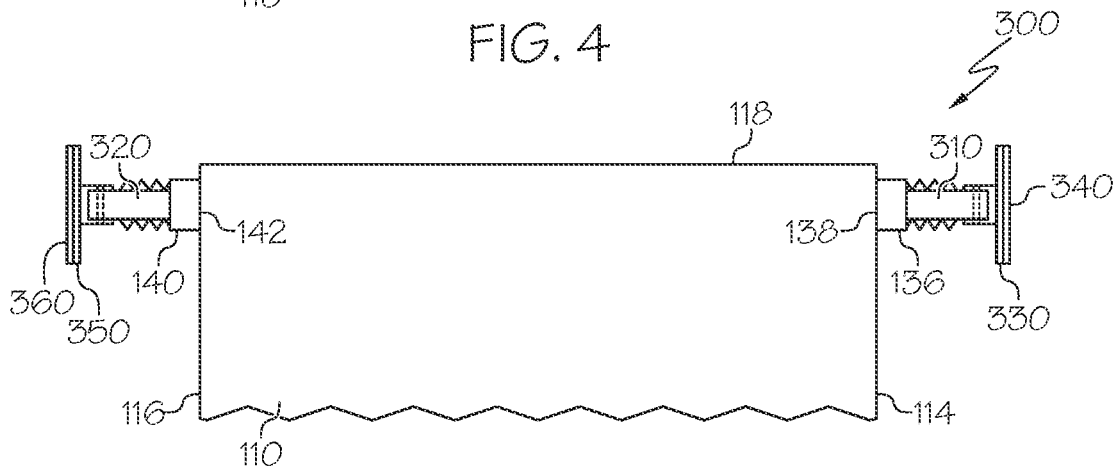
FIG. 5 is a front view of a dishwasher securing system, consistent with some embodiments of the dishwasher securing system.

FIG. 5 illustrates a front view of the dishwasher securing system 300. In the illustrated embodiment, the dishwasher 110 may include a first mounting boss 136 and a second mounting boss 142. The first mounting boss 136 may include a first threaded hole 138 therein. The first threaded hole 138 may include one or more threads 140. The second mounting boss 142 may include a second threaded hole 144 therein. The second threaded hole 144 may include one or more threads 146.

The one or more threads 140 may be configured to threadably engage with the one or more threads 316 of the first threaded extension 310. In embodiments, the first threaded extension 310 may be advanceable outwardly from the first side face 114 of the dishwasher 110 by threading the first threaded extension 310 relative to the first threaded hole 138.

The one or more threads 146 may be configured to threadably engage with the one or more threads 326 of the second threaded extension 320. In embodiments, the second threaded extension 320 may be advanceable outwardly from the second side face 116 of the dishwasher 110 by threaded the second threaded extension 320 relative to the second threaded hole 144.

The first mounting boss 136 and may be coupled to the first side face 114 by any suitable coupling mechanism, including but not limited to adhesive, magnets, mechanical fasteners, welding, geometric fit, or any other suitable coupling mechanism. The second mounting boss 142 may be coupled to the second side face 116 by any suitable coupling mechanism, including but not limited to adhesive, magnets, mechanical fasteners, welding, geometric fit, or any other suitable coupling mechanism.

Figure 6:
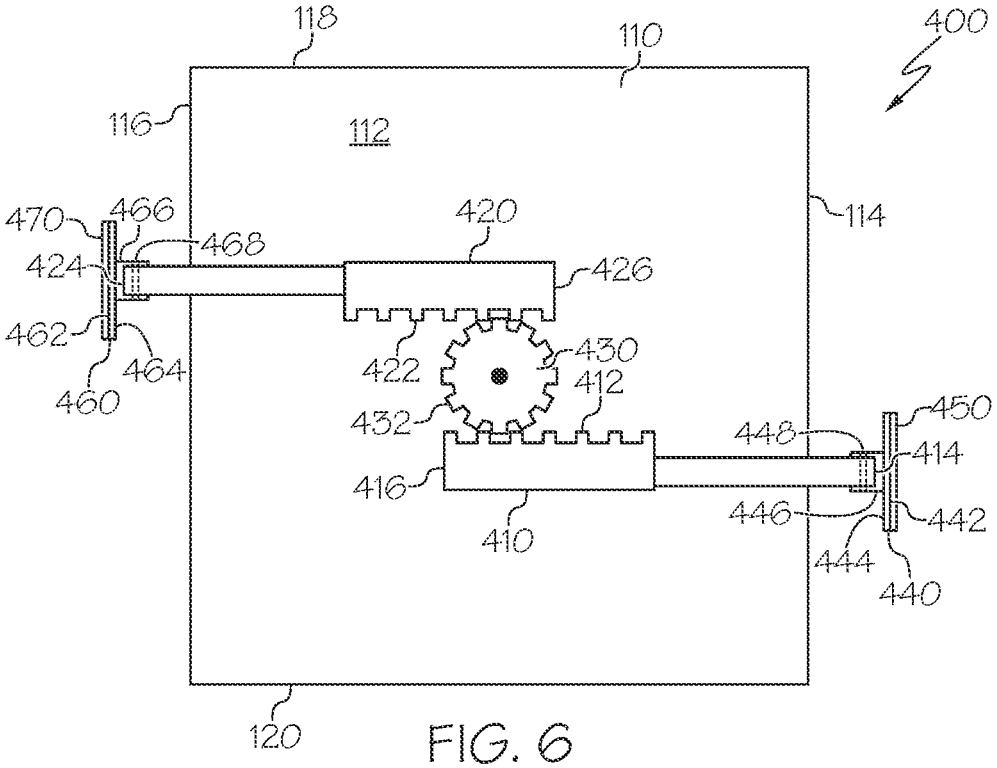
FIG. 6 is a top view of a dishwasher securing system, consistent with some embodiments of the dishwasher securing system.

FIG. 6 illustrates a top view of a dishwasher securing system 400. The dishwasher securing system 400 includes a first rack 410 and a second rack 420. The first rack 410 includes one or more grooved teeth 412, an outer end 414, and an inner end 416. While eight grooved teeth 412 are shown, it should be understood that in embodiments, any suitable number of grooved teeth may be used, including but not limited to two grooved teeth, five grooved teeth, ten grooved teeth, or any other suitable number of grooved teeth.

The first rack 410 may be slideably coupled to the top face 112 of the dishwasher 110. As a non-limiting example, the first rack 410 may be configured on a slider mechanism to allow the first rack 410 to slide relative to the top face 112 of the dishwasher.

The second rack 420 includes one or more grooved teeth 422, an outer end 424, and an inner end 426. While eight grooved teeth 422 are shown, it should be understood that in embodiments, any suitable number of grooved teeth may be used, including but not limited to two grooved teeth, five grooved teeth, ten grooved teeth, or any other suitable number of grooved teeth.

The second rack 420 may be slideably coupled to the top face 112 of the dishwasher 110. As a non-limiting example, the second rack 420 may be configured on a slider mechanism to allow the second rack 420 to slide relative to the top face 112 of the dishwasher.

The dishwasher securing system 400 includes a pinion 430. The pinion 430 includes a plurality of gear teeth 432. While thirteen gear teeth 432 are shown, it should be understood that any suitable number of gear teeth 432 may be used, including but not limited to five gear teeth, ten gear teeth, fifteen gear teeth, or any other suitable number of gear teeth.

The pinion 430 may be rotatably coupled to the top face 112 of the dishwasher 110, such that the pinion 430 may rotate clockwise and counter clockwise relative to the top face 112 of the dishwasher 110. In various embodiments, the pinion 430 may be rotatably coupled to the top face 112 of the dishwasher 110 via a coupling mechanism such as a bearing or an axle. However, it should be understood that in embodiments, any suitable type of coupling mechanism may be used.

The plurality of gear teeth 432 of the pinion 430 engage the plurality of grooved teeth 412 of the first rack 410 and the plurality of grooved teeth 422 of the second rack 420. When the plurality of gear teeth 432 of the pinion are engaged with the plurality of grooved teeth 412 of the first rack 410 and the plurality of grooved teeth 422 of the second rack 420 and the pinion 430 is rotated counterclockwise, each of the first rack 410 and the second rack 420 extend outwardly relative to the first side face 114 and the second side face 116, respectively. When the plurality of gear teeth 432 of the pinion are engaged with the plurality of grooved teeth 412 of the first rack 410 and the plurality of grooved teeth 422 of the second rack 420 and the pinion 430 is rotated clockwise, each of the first rack 410 and the second rack 420 extend inwardly relative to the first side face 114 and the second side face 116, respectively.

It should be understood that, in embodiments, the first rack 410, the second rack 420, and the pinion 430 may be arranged such that clockwise rotation of the pinion 430 results in the first rack 410 and the second rack 420 extending outwardly, and counterclockwise rotation of the pinion 430 results in the first rack 410 and the second rack 420 extending inwardly.

A first plate 440 may be coupled to the outer end 414 of the first rack 410. The first plate 440 may be a plate or similar flat structure. The first plate 440 may be configured to tension against the cabinet opening walls 104 (not shown).

The first plate 440 may include an outer face 442 and an inner face 444. A mounting bracket 446 may be coupled to the inner face 444. The mounting bracket 446 may be flexibly coupled to the first rack 410 via a mounting pin 448. The mounting pin 448 may allow the first plate 440 to flex relative to the first rack 410 and/or the cabinet opening walls 104.

In further embodiments, it is contemplated that the first plate 440 may be coupled to the first rack 410 by any other suitable coupling mechanism, including but not limited to welding or mechanical fasteners.

A first rubber insert 450 may be coupled to the outer face 442 of the first plate 440. The first rubber insert 450 may increase the coefficient of friction between the dishwasher securing system 400 and the cabinet set 102. This may aid in retaining the dishwasher 110 relative to the cabinet set 102 such as when the dishwasher 110 is bumped or otherwise receives a force load.

A second plate 460 may be coupled to the outer end 424 of the second rack 420. The second plate 460 may be a plate or similar flat structure. The second plate 460 may be configured to tension against the cabinet opening walls 104 (not shown).

The second plate 460 may include an outer face 462 and an inner face 464. A mounting bracket 466 may be coupled to the inner face 464. The mounting bracket 466 may be flexibly coupled to the second rack 420 via a mounting pin 468. The mounting pin 468 may allow the second plate 460 to flex relative to the second rack 420 and/or the cabinet opening walls 104.

In further embodiments, it is contemplated that the second plate 460 may be coupled to the second rack 420 by any other suitable coupling mechanism, including but not limited to welding or mechanical fasteners.

A second rubber insert 470 may be coupled to the outer face 462 of the second plate 460. The second rubber insert 470 may increase the coefficient of friction between the dishwasher securing system 400 and the cabinet set 102. This may aid in retaining the dishwasher 110 relative to the cabinet set 102 such as when the dishwasher 110 is bumped or otherwise receives a force load.

Figure 7:
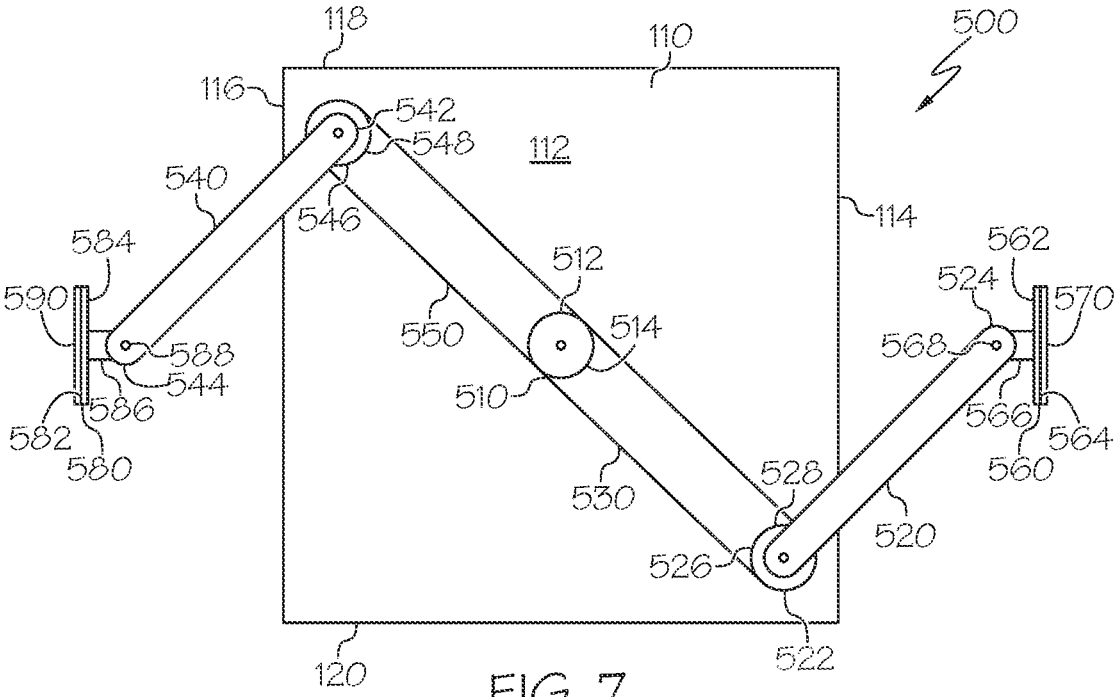
FIG. 7 is a top view of a dishwasher securing system, consistent with some embodiments of the dishwasher securing system.

FIG. 7 illustrates a top view of a dishwasher securing system 500. The dishwasher securing system 500 may include a center pulley 510. The center pulley 510 may be rotatably coupled to top face 112 of the dishwasher 110, such that the center pulley 510 may rotate clockwise and counter clockwise relative to the top face 112 of the dishwasher 110. In various embodiments, the center pulley 510 may be rotatably coupled to the top face 112 of the dishwasher 110 via a coupling mechanism such as a bearing or an axle. However, it should be understood that in embodiments, any suitable type of coupling mechanism may be used.

The center pulley 510 may have a lower groove 512 and an upper groove 514. The lower groove 512 and the upper groove 514 may be shaped and sized to allow a cable to be disposed therein, as will be discussed in more detail herein.

The dishwasher securing system 500 may include a first extending arm 520. The first extending arm 520 may include an inner end 522 and an outer end 524. The first extending arm 520 may include an outer pulley 526. The first extending arm 520 may be rotatably coupled to the top face 112 of the dishwasher 110 about the outer pulley 526, such that the first extending arm 520 may be rotated relative to the top face 112 of the dishwasher 110 about the outer pulley 526. The outer pulley 526 may have a groove 528 that is shaped and sized to allow a cable to be disposed therein.

The dishwasher securing system may include a first cable 530. The first cable 530 may be a continuous loop that may be configured to be tensioned between the outer pulley 526 and the center pulley 510. The first cable 530 may be shaped and sized to fit inside of groove 528 of the outer pulley 526 and the lower groove 512 or the upper groove 514 of the center pulley 510. The first cable 530 may translate rotational motion between the center pulley 510 and the outer pulley 526. This may allow the first extending arm 520 to be extended outwardly relative to the first side face 114 of the dishwasher 110 by rotation of the center pulley 510.

The dishwasher securing system 500 may include a second extending arm 540. The second extending arm 540 may include an inner end 542 and an outer end 544. The second extending arm 540 may include an outer pulley 546. The second extending arm 540 may be rotatably coupled to the top face 112 of the dishwasher 110 about the outer pulley 546, such that the second extending arm 540 may be rotated relative to the top face 112 of the dishwasher 110 about the outer pulley 546. The outer pulley 546 may have a groove 548 that is shaped and sized to allow a cable to be disposed therein.

The dishwasher securing system 500 may include a second cable 550. The second cable 550 may be a continuous loop that may be configured to be tensioned between the outer pulley 546 and the center pulley 510. The second cable 550 may be shaped and sized to fit inside of groove 548 of the outer pulley 546 and the lower groove 512 or the upper groove 514 of the center pulley 510. The second cable 550 may translate rotational motion between the center pulley 510 and the outer pulley 546. This may allow the second extending arm 540 to be extended outwardly relative to the first side face 114 of the dishwasher 110 by rotation of the center pulley 510.

A first plate 560 may be coupled to the outer end 524 of the first extending arm 520. The first plate 560 may be a plate or similar flat structure. The first plate 560 may be configured to tension against the cabinet opening walls 104 (not shown).

The first plate 560 may include an outer face 562 and an inner face 564. A mounting bracket 566 may be coupled to the inner face 564. The mounting bracket 566 may be flexibly coupled to the first extending arm 520 via a mounting pin 568. The mounting pin 568 may allow the first plate 560 to flex relative to the first extending arm 520 and/or the cabinet opening walls 104.

In further embodiments, it is contemplated that the first plate 560 may be coupled to the first extending arm 520 by any other suitable coupling mechanism, including but not limited to welding or mechanical fasteners.

A first rubber insert 570 may be coupled to the outer face 562 of the first plate 560. The first rubber insert 570 may increase the coefficient of friction between the dishwasher securing system 500 and the cabinet set 102. This may aid in retaining the dishwasher 110 relative to the cabinet set 102 such as when the dishwasher 110 is bumped or otherwise receives a force load.

A second plate 580 may be coupled to the outer end 544 of the second extending arm 540. The second plate 580 may be a plate or similar flat structure. The second plate 580 may be configured to tension against the cabinet opening walls 104 (not shown).

The second plate 580 may include an outer face 582 and an inner face 584. A mounting bracket 586 may be coupled to the inner face 584. The mounting bracket 586 may be flexibly coupled to the second extending arm 540 via a mounting pin 588. The mounting pin 588 may allow the second plate 580 to flex relative to the second extending arm 540 and/or the cabinet opening walls 104.

In further embodiments, it is contemplated that the second plate 580 may be coupled to the second extending arm 540 by any other suitable coupling mechanism, including but not limited to welding or mechanical fasteners.

A second rubber insert 590 may be coupled to the outer face 582 of the second plate 580. The second rubber insert 590 may increase the coefficient of friction between the dishwasher securing system 400 and the cabinet set 102. This may aid in retaining the dishwasher 110 relative to the cabinet set 102 such as when the dishwasher 110 is bumped or otherwise receives a force load.

Figure 8:
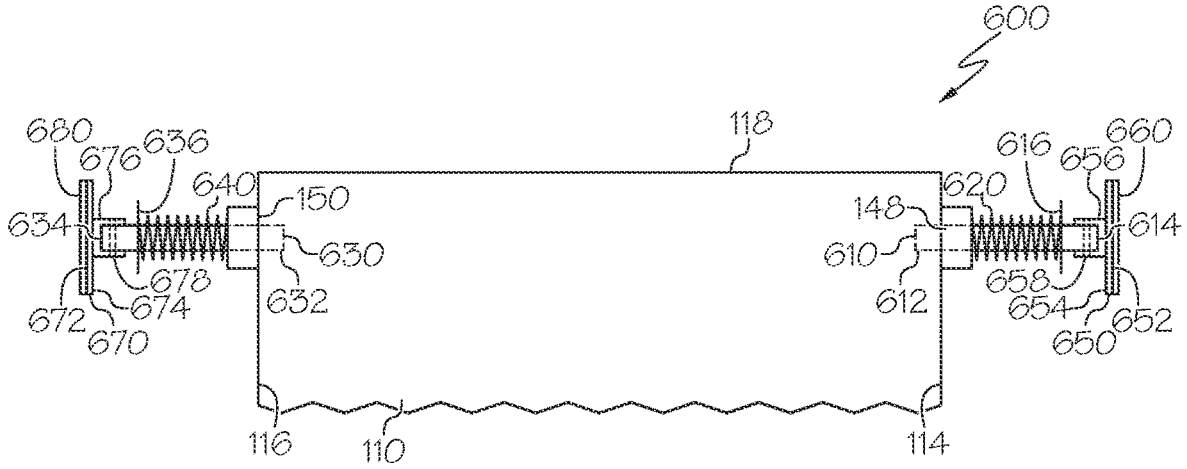
FIG. 8 is a front view of a dishwasher securing system, consistent with some embodiments of the dishwasher securing system.

FIG. 8 illustrates a front view of a dishwasher securing system 600. The dishwasher securing system 600 may include a first pin 610 and a second pin 630. The first pin 610 may include an inner end 612, an outer end 614, and a first flange 616 placed between the inner end 612 and the outer end 614.

The first pin 610 may be disposed through a first pin hole 148 formed in the first side face 114 of the dishwasher 110. The second pin 630 may be disposed through a second pin hole 150 formed in the second side face 116 of the dishwasher 110.

A first spring 620 may bias the first pin 610 outwardly from the first side face 114 of the dishwasher 110. As illustrated, the first spring 620 may be a coil spring that wraps around the first pin 610 and biases the first pin 610 by applying a spring force between the first side face 114 of the dishwasher 110 and the first flange 616 of the first pin. However, it should be understood that, in embodiments, the first spring 620 may be any suitable type of spring, including but not limited to a torsion spring, a spiral spring, a leaf spring, or any other suitable type of spring. The first flange 616 may be shaped and sized to allow an operator to compress the first spring 620 by pressing against the first flange 616.

The second pin 630 may include an inner end 632, an outer end 634, and a second flange 636 placed between the inner end 632 and the outer end 634. A second spring 640 may bias the second pin 630 outwardly from the second side face 116 of the dishwasher 110. As illustrated, the second spring 640 may be a coil spring that wraps around the second pin 630 and biases the second pin 630 by applying a spring force between the second side face 116 of the dishwasher 110 and the second flange 636 of the second pin 630. However, it should be understood that, in embodiments, the second spring 640 may be any suitable type of spring, including but not limited to a torsion spring, a spiral spring, a leaf spring, or any other suitable type of spring. The second flange 636 may be shaped and sized to allow an operator to compress the second spring 640 by pressing against the second flange 636.

A first plate 650 may be coupled to the outer end 614 of the first pin 610. The first plate 650 may be a plate or similar flat structure. The first plate 650 may be configured to tension against the cabinet opening walls 104 (not shown).

The first plate 650 may include an outer face 652 and an inner face 654. A mounting bracket 656 may be coupled to the inner face 654. The mounting bracket 656 may be flexibly coupled to the first pin 610 via a mounting pin 658. The mounting pin 658 may allow the first plate 650 to flex relative to the first pin 610 and/or the cabinet opening walls 104.

In further embodiments, it is contemplated that the first plate 650 may be coupled to the first pin 610 by any other suitable coupling mechanism, including but not limited to welding or mechanical fasteners.

A first rubber insert 660 may be coupled to the outer face 652 of the first plate 650. The first rubber insert 660 may increase the coefficient of friction between the dishwasher securing system 600 and the cabinet set 102. This may aid in retaining the dishwasher 110 relative to the cabinet set 102 such as when the dishwasher 110 is bumped or otherwise receives a force load.

A second plate 670 may be coupled to the outer end 634 of the second pin 630. The second plate 670 may be a plate or similar flat structure. The second plate 670 may be configured to tension against the cabinet opening walls 104 (not shown).

The second plate 670 may include an outer face 672 and an inner face 674. A mounting bracket 676 may be coupled to the inner face 674. The mounting bracket 676 may be flexibly coupled to the second pin 630 via a mounting pin 678. The mounting pin 678 may allow the second plate 670 to flex relative to the second pin 630 and/or the cabinet opening walls 104.

In further embodiments, it is contemplated that the second plate 670 may be coupled to the second pin 630 by any other suitable coupling mechanism, including but not limited to welding or mechanical fasteners.

A second rubber insert 680 may be coupled to the outer face 672 of the second plate 670. The second rubber insert 680 may increase the coefficient of friction between the dishwasher securing system 600 and the cabinet set 102. This may aid in retaining the dishwasher 110 relative to the cabinet set 102 such as when the dishwasher 110 is bumped or otherwise receives a force load.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to that the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A dishwasher securing system, the system comprising:

a dishwasher, the dishwasher having a housing having a top face, a bottom face, and one or more side faces;

a threaded housing, the threaded housing coupled to the top face of the dishwasher, the threaded housing having a plurality of threaded holes;

a first threaded leg extending from the threaded housing, the first threaded leg having one or more threads configured to engage at least one of the plurality of threaded holes of the threaded housing; and a second threaded leg extending from the threaded housing, the second threaded leg having one or more threads configured to engage at least one of the plurality of threaded holes of the threaded housing.

2. The dishwasher securing system of claim 1, wherein the top face of the dishwasher further comprises an access panel.

3. The dishwasher securing system of claim 2, wherein at least one of the first threaded leg or the second threaded leg are accessible through the access panel.

4. The dishwasher securing system of claim 1, further comprising:

the first threaded leg having an outer end, wherein a first plate is coupled to the outer end of the first threaded leg; and the second threaded leg having an outer end, wherein a second plate is coupled to the outer end of the second threaded leg.

5. The dishwasher securing system of claim 4, further comprising:

the first plate has an outer face, wherein a first rubber insert is coupled to the outer face of the first plate; and the second plate has an outer face, wherein a second rubber insert is coupled to the outer face of the second plate.

6. The dishwasher securing system of claim 4, wherein the first plate is flexibly coupled to the outer end of the first threaded leg, and the second plate is flexibly coupled to the outer end of the second threaded leg.

7. The dishwasher securing system of claim 1, wherein the threaded housing comprises:

a first sidewall having a first threaded hole; and a second sidewall having a second threaded hole, wherein the second sidewall is opposite to the first sidewall.

8. A dishwasher securing system, the system comprising:

a dishwasher, the dishwasher having a housing having a top face, a bottom face, and a plurality of side faces;

a threaded housing coupled to the top face of the dishwasher, the threaded housing having a plurality of threaded holes; and one or more threaded extensions coupled to one of the threaded holes or one of the plurality of side faces, wherein each of the one or more threaded extensions are configured to be threaded outward relative to one of the plurality of side faces of the dishwasher.

9. The dishwasher securing system of claim 8, wherein the one or more threaded extensions comprises a first threaded extension and a second threaded extension, wherein the first threaded extension is coupled to a first side face, the second threaded extension is coupled to a second side face, and the first side face and the second side face are opposite of one another.

10. The dishwasher securing system of claim 9, wherein the first side face of the housing has a first threaded hole, the second side face of the housing has a second threaded hole, wherein:

the first threaded extension is configured to threadably engage the first threaded hole; and the second threaded extension is configured to threadably engage the second threaded hole.

11. The dishwasher securing system of claim 9, further comprising:

the first threaded extension having an outer end, wherein a first plate is coupled to the outer end of the first threaded extension; and the second threaded extension having an outer end, wherein a second plate is coupled to the outer end of the second threaded extension.

12. The dishwasher securing system of claim 11, further comprising:

the first plate has an outer face, wherein a first rubber insert is coupled to the outer face of the first plate; and the second plate has an outer face, wherein a second rubber insert is coupled to the outer face of the second plate.

13. The dishwasher securing system of claim 11, wherein the first plate is flexibly coupled to the outer end of the first threaded extension, and the second plate is flexibly coupled to the outer end of the second threaded extension.

14. The dishwasher securing system of claim 9, further comprising:

one or more mounting bosses, each of the one or more mounting bosses having a threaded hole and being mounted to one of the plurality of side faces of the dishwasher, wherein each of the one or more threaded extensions are configured to threadably engage one of the one or more mounting bosses.

15. A dishwasher securing system, the system comprising:

a dishwasher, the dishwasher having a housing having a top face, a bottom face, and a plurality of side faces;

a plurality of racks, each of the plurality of racks having a plurality of grooved teeth;

one or more arms coupled to each of the plurality of racks;

a pinion, the pinion having a plurality of gear teeth and the pinion rotatably coupled to the top face of the dishwasher, wherein the pinion is configured to engage the plurality of grooved teeth of the plurality of racks and rotate clockwise or counter clockwise relative to the top face, wherein:

each of the plurality of racks are configured to extend outwardly when engaged by the pinion.

16. The dishwasher securing system of claim 15, further comprising:

a first rack configured to be extended outwardly from a first side face of the dishwasher; and a second rack configured to be extended outwardly from a second side face of the dishwasher, wherein the second side face is opposite of the first side face.

17. The dishwasher securing system of claim 16, wherein the pinion is configured to simultaneously move the first rack and the second rack.

18. The dishwasher securing system of claim 16, wherein:

the first rack further comprises an outer end, wherein a first plate is coupled to the outer end of the first rack; and the second rack further comprises an outer end, wherein a second plate is coupled to the outer end of the second rack.

19. The dishwasher securing system of claim 18, further comprising:

the first plate having an outer face, wherein a first rubber insert is coupled to the outer face of the first plate; and the second plate having an outer face, wherein a second rubber insert is coupled to the outer face of the second plate.

20. The dishwasher securing system of claim 18, wherein the first plate is flexibly coupled to the outer end of the first rack, and the second plate is flexibly coupled to the outer end of the second rack.

* * * * *